US011209006B2

(12) United States Patent
Ganesh et al.

(10) Patent No.: US 11,209,006 B2
(45) Date of Patent: Dec. 28, 2021

(54) MOTOR COOLING DEVICE AND METHOD

(71) Applicant: Twin City Fan Companies, Ltd., Plymouth, MN (US)

(72) Inventors: Radha Krishna Ganesh, Rogers, MN (US); Henry Thomas Bugner, Jr., Minneapolis, MN (US); Jason Dean Emiliusen, Anoka, MN (US); Trinity Persful, Maple Grove, MN (US)

(73) Assignee: Twin City Fan Companies, Ltd., Plymouth, MN (US)

( * ) Notice: Subject to any disclaimer, the term of this patent is extended or adjusted under 35 U.S.C. 154(b) by 648 days.

(21) Appl. No.: 15/509,657

(22) PCT Filed: Aug. 3, 2015

(86) PCT No.: PCT/US2015/043395
§ 371 (c)(1),
(2) Date: Mar. 8, 2017

(87) PCT Pub. No.: WO2016/039890
PCT Pub. Date: Mar. 17, 2016

(65) Prior Publication Data

US 2017/0284404 A1 Oct. 5, 2017

Related U.S. Application Data

(60) Provisional application No. 62/047,942, filed on Sep. 9, 2014.

(51) Int. Cl.
*F04D 25/08* (2006.01)
*F04D 29/053* (2006.01)
(Continued)

(52) U.S. Cl.
CPC ..... *F04D 25/082* (2013.01); *F04D 17/16* (2013.01); *F04D 19/002* (2013.01); *F04D 25/06* (2013.01);
(Continued)

(58) Field of Classification Search
CPC ..... F04D 13/02; F04D 13/06; F04D 13/0646; F04D 25/02; F04D 25/06; F04D 25/0666;
(Continued)

(56) References Cited

U.S. PATENT DOCUMENTS 3,368,746 A 2/1968 Zelinski
4,909,711 A 3/1990 Burgbacher et al.
(Continued)

FOREIGN PATENT DOCUMENTS

EP 0053703 A2 6/1982
WO WO-2016039890 A2 3/2016
WO WO-2016039890 A3 3/2016

OTHER PUBLICATIONS

"International Application Serial No. PCT US2015 043395, International Preliminary Report on Patentability dated Mar. 24, 2017", 9 pgs.
(Continued)

*Primary Examiner* — Charles G Freay
*Assistant Examiner* — Chirag Jariwala
(74) *Attorney, Agent, or Firm* — Schwegman Lundberg & Woessner, P.A.

(57) ABSTRACT

A fan assembly, including motor cooling configurations and/or integrated controller configurations and associated methods are shown. Some examples of fan motors shown include electronically commutated motors that may include integrated controller circuitry. A number of cooling configurations are shown that may be used individually or in combination to provide cooling to a motor in a fan assembly.

5 Claims, 11 Drawing Sheets

(51) Int. Cl.

| | |
|---|---|
| ***F04D 17/16*** | (2006.01) |
| ***F04D 19/00*** | (2006.01) |
| ***F04D 25/06*** | (2006.01) |
| ***F04D 27/00*** | (2006.01) |
| ***F04D 29/44*** | (2006.01) |
| ***F04D 29/54*** | (2006.01) |

(52) U.S. Cl.
CPC ..... *F04D 27/004* (2013.01); *F04D 29/053* (2013.01); *F04D 29/441* (2013.01); *F04D 29/541* (2013.01)

(58) Field of Classification Search
CPC .. F04D 25/082; F04D 27/004; F04D 29/5806; F04D 29/582; F04D 17/16; F04D 19/002; F04D 29/441; F04D 29/541; F04D 29/053; H02K 9/02–06; H02K 9/22
USPC ..... 417/366, 368, 372, 410.1, 423.7, 423.8, 417/423.14
See application file for complete search history.

(56) References Cited

U.S. PATENT DOCUMENTS

| | | | | |
|---|---|---|---|---|
| 5,375,651 | A | 12/1994 | Colwell | |
| 5,743,721 | A | 4/1998 | Graham et al. | |
| 8,215,928 | B2 * | 7/2012 | Agrawal | F04D 29/584 415/178 |
| 2008/0193305 | A1 | 8/2008 | Tateishi et al. | |
| 2011/0068644 | A1 * | 3/2011 | Kamp | H02K 9/08 310/53 |
| 2011/0229358 | A1 | 9/2011 | Streng et al. | |
| 2013/0022479 | A1 * | 1/2013 | Haaf | F04D 29/5813 417/369 |
| 2014/0205464 | A1 * | 7/2014 | Vohlgemuth | F04D 27/004 417/44.1 |
| 2014/0227081 | A1 | 8/2014 | Wang | |
| 2015/0069861 | A1 * | 3/2015 | Buttner | H02K 1/32 310/43 |
| 2016/0006325 | A1 * | 1/2016 | Grabner | H02K 9/06 310/62 |
| 2016/0069349 | A1 * | 3/2016 | Kreidler | F04D 13/06 417/423.7 |

OTHER PUBLICATIONS

"Application Serial No. PCT/US2015/043395, Invitation to Pay Add'l Fees and Partial Search Rpt dated Sep. 16, 2015", 2 pgs.
"International Application Serial No. PCT/US2015/043395, International Search Report dated Dec. 11, 2015", 4 pgs.
"International Application Serial No. PCT/US2015/043395, Written Opinion dated Dec. 11, 2015", 7 pgs.

* cited by examiner

500

MOTOR COOLING DEVICE AND METHOD

RELATED APPLICATION

This application is a U.S. National Stage Filing under 35 U.S.C. 371 from International Patent Application Serial No. PCT/US2015/043395, filed Aug. 3, 2015, published on Mar. 17, 2016 as WO 2016/039890 A2, which application claims the benefit of priority to U.S. patent application Ser. No. 62/047,942, filed Sep. 9, 2014, the content of which is incorporated herein by reference in its entirety.

TECHNICAL FIELD

Embodiments described herein generally relate to fan assemblies. Specific examples may include plenum or plug fan housings and fan assemblies and centrifugal fan assemblies.

BACKGROUND DESCRIPTION OF THE DRAWINGS

In some fan applications, electrically commutated motors can provide a number of desirable advantages, such as a more favorable compact geometry, and an ability to more precisely control motor parameters, such as motor speed. Electrically commutated motors, and electric motors in general, can generate an amount of heat sufficient to affect performance of the fan assembly. An improved fan assembly and methods that addresses at least these concerns are desired.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
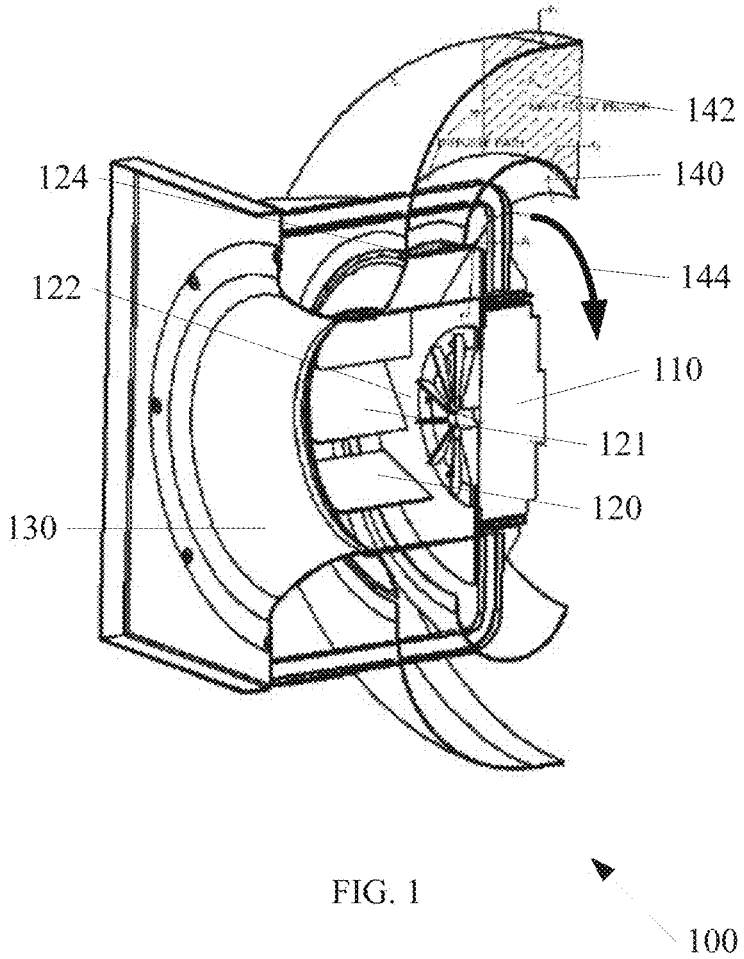
FIG. 1 is a cross section of a fan assembly in accordance with some embodiments of the invention.

FIG. 1 shows a fan assembly 100 according to an embodiment of the invention. The fan assembly includes a fan motor 110, and an impeller 120. The impeller 120 shown includes a number of primary blades 121 that define an air inlet region 122 and a periphery 124. In the example shown, the impeller 120 is a centrifugal impeller, however the invention is not so limited. Selected examples may be used with other impeller configurations, including, but not limited to axial impellers and mixed flow impellers.

An inlet funnel 130 is shown positioned to direct air into the air inlet region 122. In one example, the fan assembly 100 may be used in a plenum configuration. In one example, one or more deflectors 140 are included to modify air flow from the periphery 124 of the impeller 120. In one example one of the deflectors 140 may include a diffuser to reduce fan noise created by air as it leaves the periphery 124 of the impeller 120. In one example one or more of the deflectors 140 is positioned to direct a portion 144 of outflowing air over the fan motor 110.

In the example shown, a portion of outflowing air 142 is directed away from the fan assembly 100. At the same time, a different portion 144 of the outflowing air is directed over the fan motor 110 as indicated by the arrow in FIG. 1. In one example the fan motor 110 includes an electronically commutated motor. In one example, an electronically commutated motor may include integrated control electronics. In one example the integrated control electronics includes variable speed control electronics. Example motors 110 that include integrated electronic controls may be more sensitive to temperature than other non-integrated motor configurations. It is beneficial to provide a mechanism, such as increased air flow over the motor 110 to cool the integrated electronics to within a more efficient operating temperature.

Figure 2:
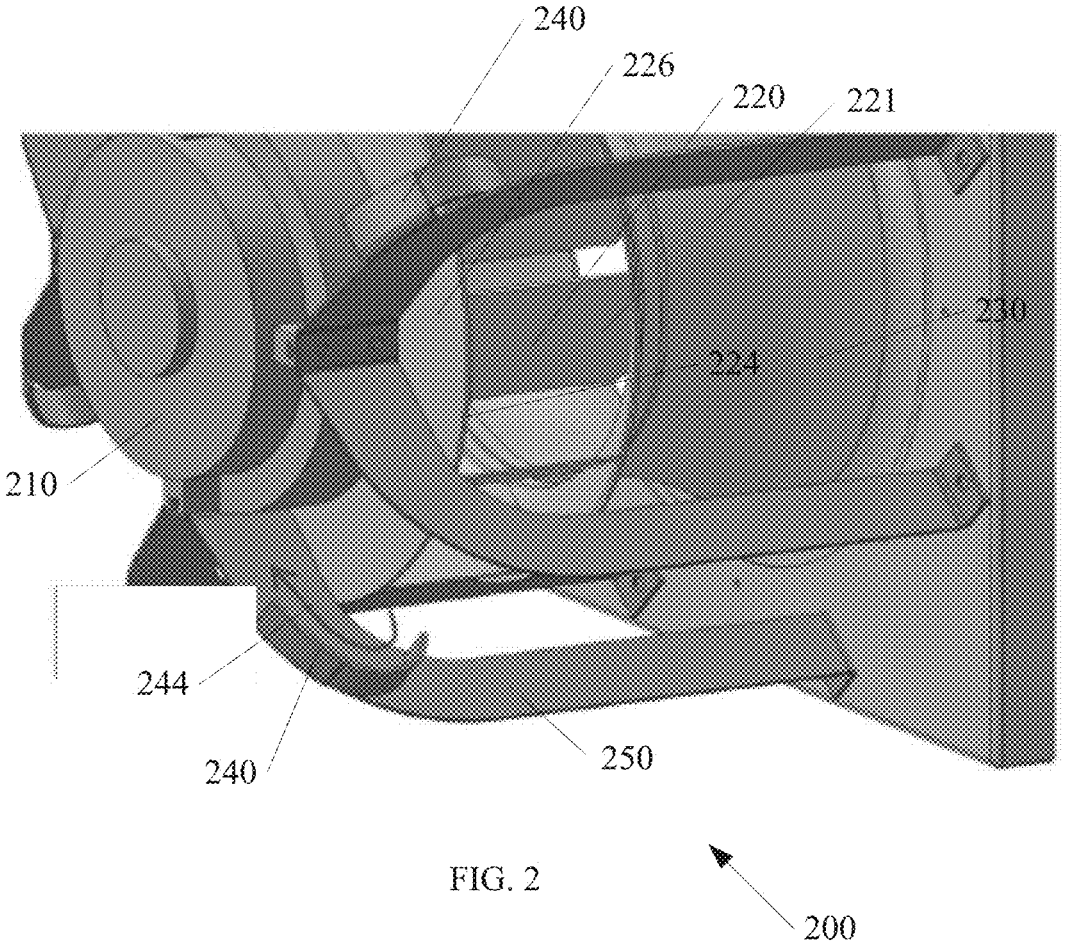
FIG. 2 is an isometric view of a fan assembly in accordance with some embodiments of the invention.

FIG. 2 shows another fan assembly 200 according to an embodiment of the invention. The fan assembly includes a fan motor 210, and an impeller 220. Similar to the example shown in FIG. 1, the impeller 220 includes a number of primary blades 221 that define an air inlet region and a periphery 224. A backplate 226 is shown to couple a drive shaft (not shown) of the motor 210 with the primary blades 221. As discussed above, a centrifugal impeller 220 is shown, however other impeller types may also be used with examples of the invention. An inlet funnel 230 is shown to direct air into an air inlet region of the impeller 220.

In the example of FIG. 2, multiple deflectors 240 are shown positioned to direct a portion 244 of outflowing air over the fan motor 110. In the example of FIG. 2, the multiple deflectors 240 are positioned on one or more motor support members 250. Although the invention is not so limited, in one example, the fan motor 210 is an electronically commutated motor with integrated control circuitry.

Figure 3:
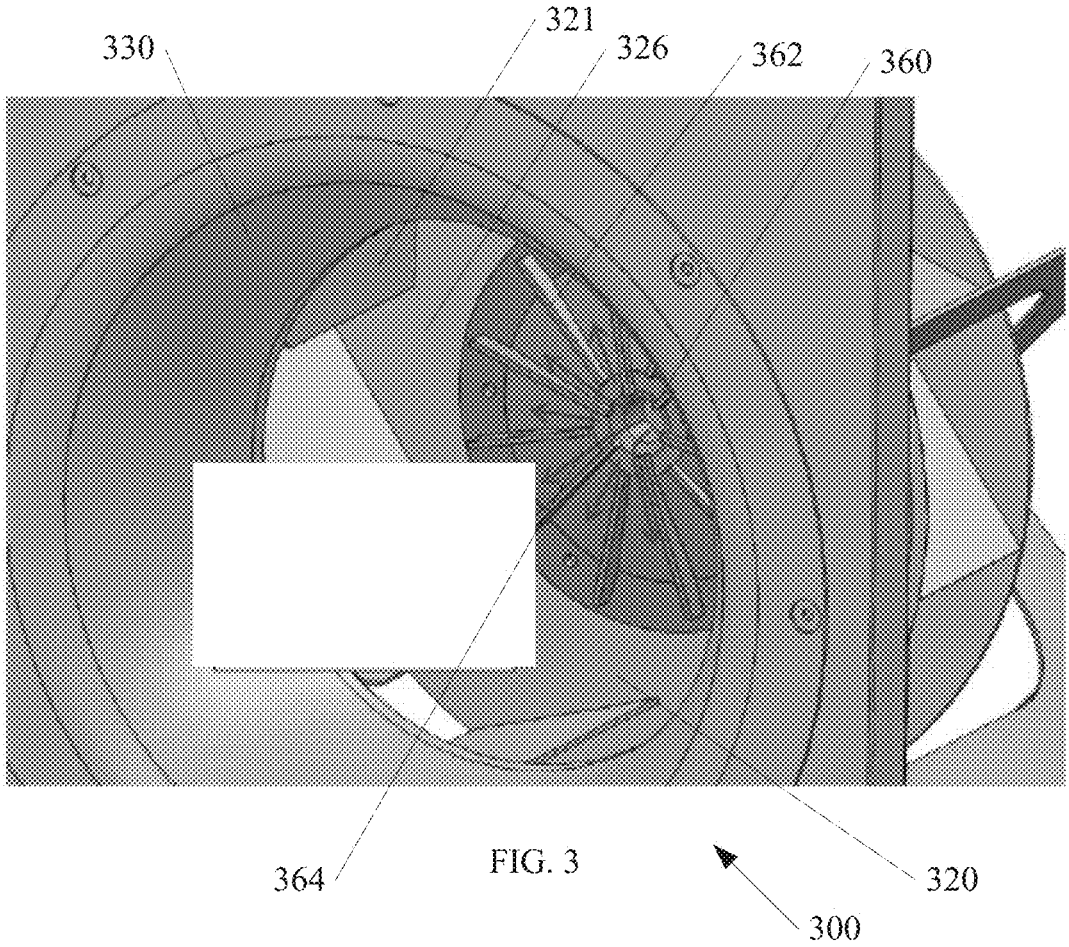
FIG. 3 is an isometric view of a fan assembly in accordance with some embodiments of the invention.

FIG. 3 shows another fan assembly 300 according to an embodiment of the invention. The fan assembly includes a fan motor, and an impeller 320. Similar to the example shown in previous examples, the impeller 320 includes a number of primary blades 321 that define an air inlet region and a periphery. A backplate 326 is shown to couple a drive shaft 360 of the motor with the primary blades 321. As discussed above, a centrifugal impeller 320 is shown, however other impeller types may also be used with examples of the invention. An inlet funnel 330 is shown to direct air into an air inlet region of the impeller 320.

In the example of FIG. 3, the drive shaft 360 of the motor is hollow. In such a configuration, hot air from around the motor is circulated through the hollow drive shaft 260. In one example, a differential in pressure from one side of the hollow drive shaft 360 to the other causes motion of air to promote motor cooling. In the example shown, the air from a backside of the motor is drawn into the air inlet region of the impeller 320 at least in part due to a low pressure condition within the air inlet region, and a higher pressure condition on the backside of the motor. An example of air flow is indicated by arrows 364.

In the example shown, a number of secondary blades 362 are further included to promote a flow or air from the backside of the motor, and through the hollow drive shaft 360. In the example shown, the number of secondary blades 362 are attached to the backplate 326 of the impeller 320. Although the invention is not so limited, in one example, the fan motor of the fan assembly 300 is an electronically commutated motor with integrated control circuitry.

Figure 4:
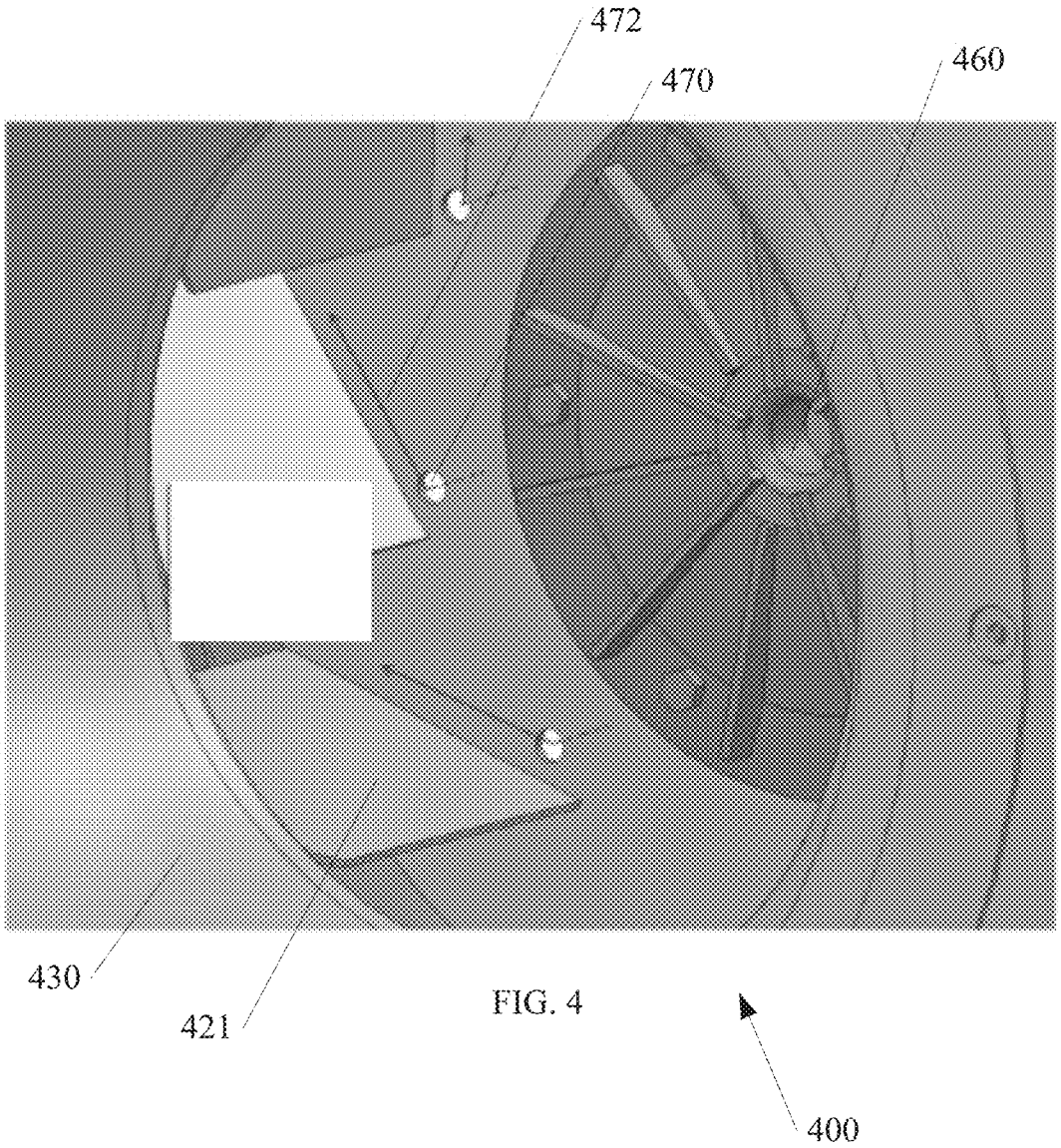
FIG. 4 is an isometric view of a fan assembly in accordance with some embodiments of the invention.

FIG. 4 shows another fan assembly 400 according to an embodiment of the invention. The fan assembly includes a fan motor, and an impeller 420. Similar to the example shown in previous examples, the impeller 420 includes a number of primary blades 421 that define an air inlet region and a periphery. A backplate 426 is shown to couple a drive shaft 460 of the motor with the primary blades 421. As discussed above, a centrifugal impeller 420 is shown, however other impeller types may also be used with examples of the invention. An inlet funnel 430 is shown to direct air into an air inlet region of the impeller 320.

Similar to the example of FIG. 3, in the example of FIG. 4, the drive shaft 460 of the motor is hollow. In such a configuration, hot air from around the motor is circulated through the hollow drive shaft 260. Although a hollow drive shaft 460 is shown in FIG. 4, other examples may not include a hollow drive shaft.

In the example shown, a number of holes 470 are further included in the backplate 426 to promote a flow or air 472 from the motor into an air inlet region of the impeller 420. Example configurations including holes 470 may be combined with one or more additional cooling configurations described in the present disclosure. Although the invention is not so limited, in one example, the fan motor of the fan assembly 400 is an electronically commutated motor with integrated control circuitry.

Figure 5:
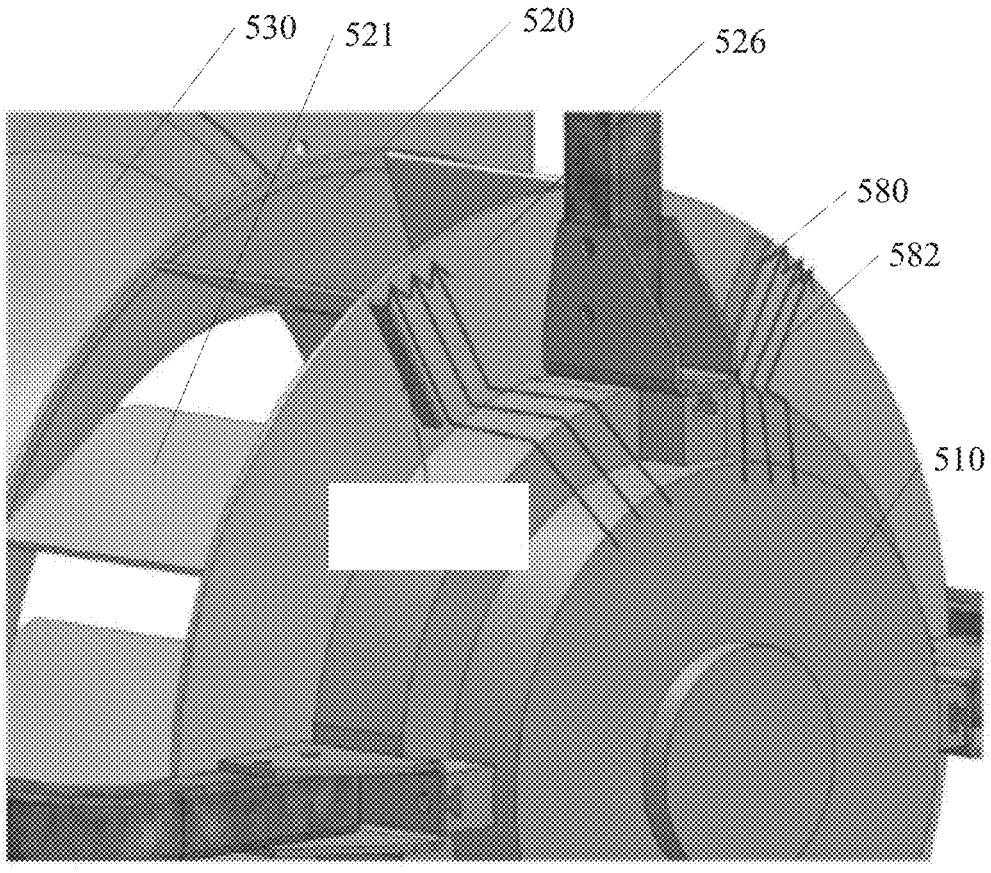
FIG. 5 is an isometric view of a fan assembly in accordance with some embodiments of the invention.

FIG. 5 shows another fan assembly 500 according to an embodiment of the invention. The fan assembly includes a fan motor 510, and an impeller 520. Similar to the example shown in previous examples, the impeller 520 includes a number of primary blades 521 that define an air inlet region and a periphery. A backplate 526 is shown to couple a drive shaft (not shown) of the motor 510 with the primary blades 521. As discussed above, a centrifugal impeller 520 is shown, however other impeller types may also be used with examples of the invention. An inlet funnel 530 is shown to direct air into an air inlet region of the impeller 520.

In the example shown, a number of blades 580 are attached to a backside of the backplate 526 to promote a flow or air 582 over and away from the motor. Example configurations including blades 580 may be combined with one or more additional cooling configurations described in the present disclosure. Although the invention is not so limited, in one example, the fan motor of the fan assembly 500 is an electronically commutated motor with integrated control circuitry.

Figure 6:
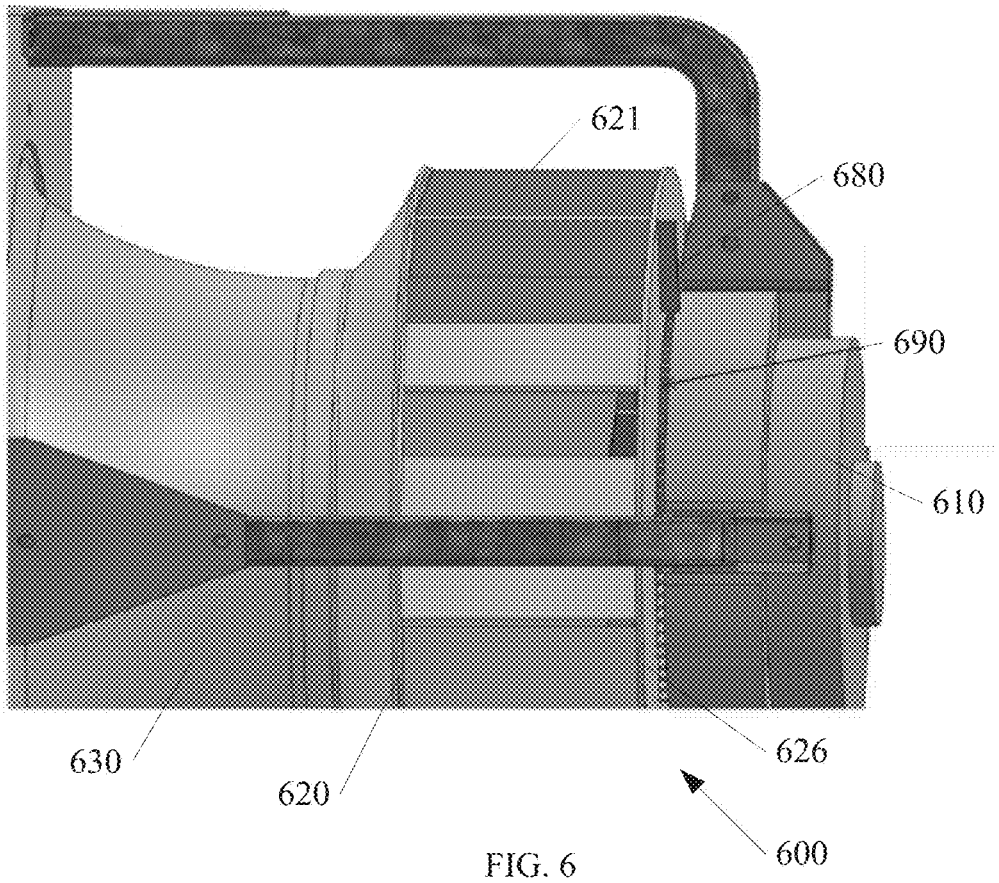
FIG. 6 is a side view of a fan assembly in accordance with some embodiments of the invention.

FIG. 6 shows another fan assembly 600 according to an embodiment of the invention. The fan assembly includes a fan motor 610, and an impeller 620. Similar to the example shown in previous examples, the impeller 620 includes a number of primary blades 621 that define an air inlet region and a periphery. A backplate 626 is shown to couple a drive shaft (not shown) of the motor 610 with the primary blades 621. As discussed above, a centrifugal impeller 620 is shown, however other impeller types may also be used with examples of the invention. An inlet funnel 630 is shown to direct air into an air inlet region of the impeller 620.

In the example shown, a number of cooling fins 690 are located on a face of the fan motor 610 directly facing the backplate 626 of the impeller 620. In one example rotation of the impeller 620 adjacent to the number of cooling fins 690 provides an amount of air circulation that removes heat from the fan motor 610 thought the number of cooling fins 690. Similar to the example in FIG. 5, a number of blades 680 are also shown attached to a backside of the backplate 626 to promote a flow or air over and away from the motor 610. In one example, the combination of blades 680 with the number of cooling fins 690 provides increased cooling by promoting air flow over the number of cooling fins 690.

Example configurations including cooling fins 690 may be combined with one or more additional cooling configurations described in the present disclosure. Although the invention is not so limited, in one example, the fan motor of the fan assembly 600 is an electronically commutated motor with integrated control circuitry.

Figure 7:
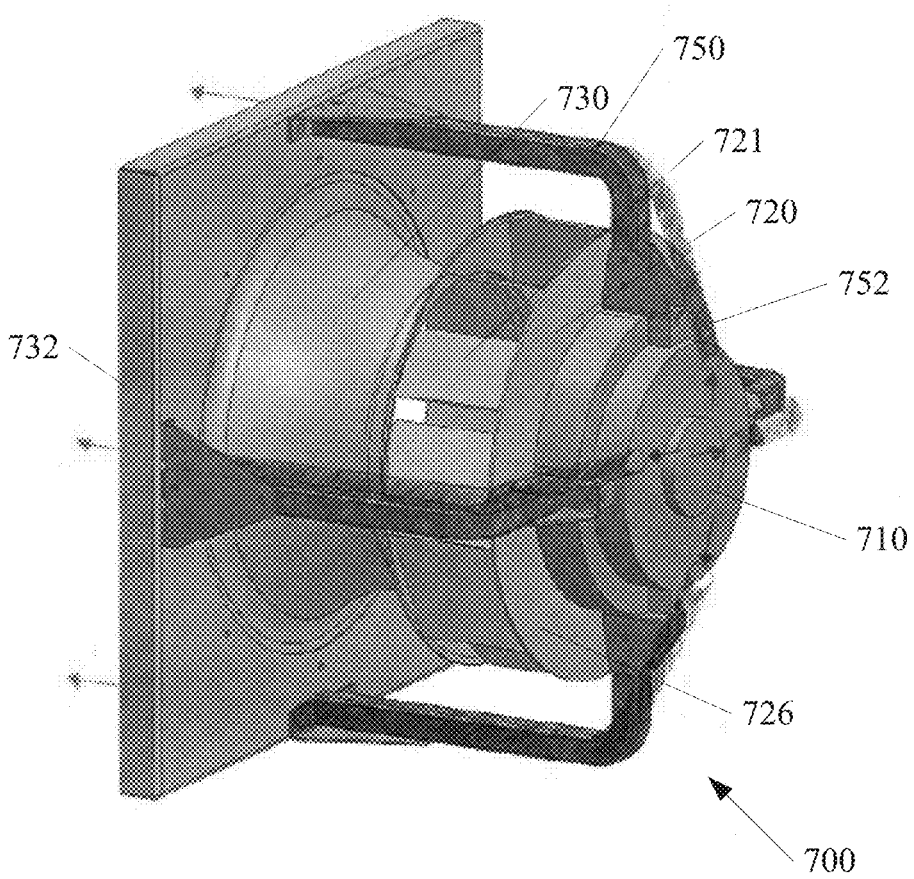
FIG. 7 is an isometric view of a fan assembly in accordance with some embodiments of the invention.

FIG. 7 shows another fan assembly 700 according to an embodiment of the invention. The fan assembly includes a fan motor 710, and an impeller 720. Similar to the example shown in previous examples, the impeller 720 includes a number of primary blades 721 that define an air inlet region and a periphery. A backplate 726 is shown to couple a drive shaft (not shown) of the motor 710 with the primary blades 721. As discussed above, a centrifugal impeller 720 is shown, however other impeller types may also be used with examples of the invention. An inlet funnel 730 is shown to direct air into an air inlet region of the impeller 720.

In the example shown, one or more channels 752 are included to draw air from the fan motor 710 to a front 732 of the inlet funnel 730. In one example, the channels 752 are aligned with a number of motor support members 750. In one example, the channels 752 are integrated within one or more of the motor support members 750. Example configurations including channels 752 may be combined with one or more additional cooling configurations described in the present disclosure.

Figure 8:
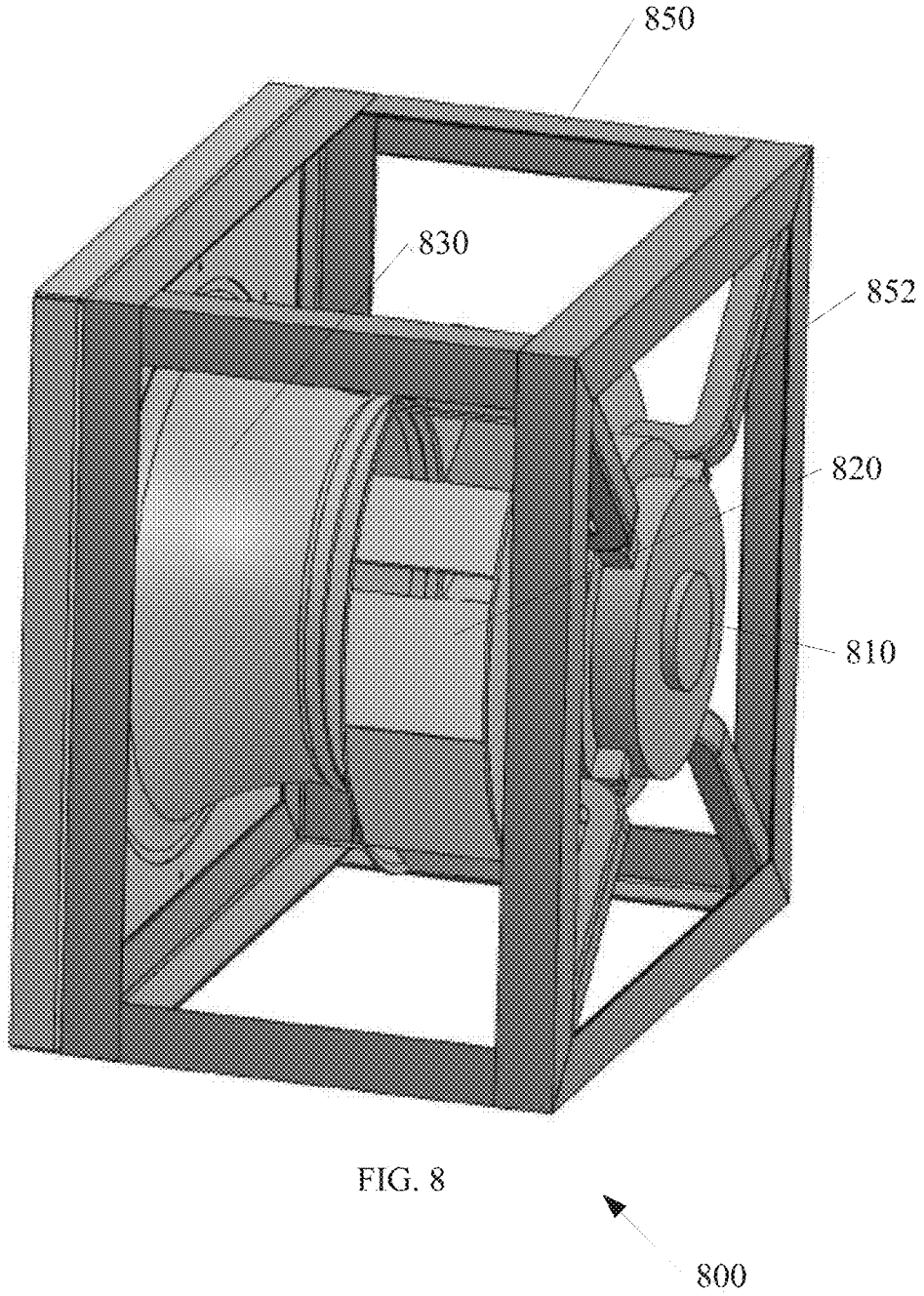
FIG. 8 is an isometric view of a fan assembly in accordance with some embodiments of the invention.

FIG. 8 shows one or more channels 852 integrated into one or more of the motor support members 850. In the example of FIG. 8, the motor support members 850 are each located in corners of inlet funnel 830. By locating support members 850 in corners of the inlet funnel 830, a distance of the fan motor 810 and impeller 820 from stationary support locations is increased. Corner mounting locations are farther away than locations along a side of an inlet funnel, as illustrated in FIG. 7. In one example, increasing a distance between the fan motor 810 and impeller 820 from stationary support locations reduces noise generated by the fan system 800.

Figure 9:
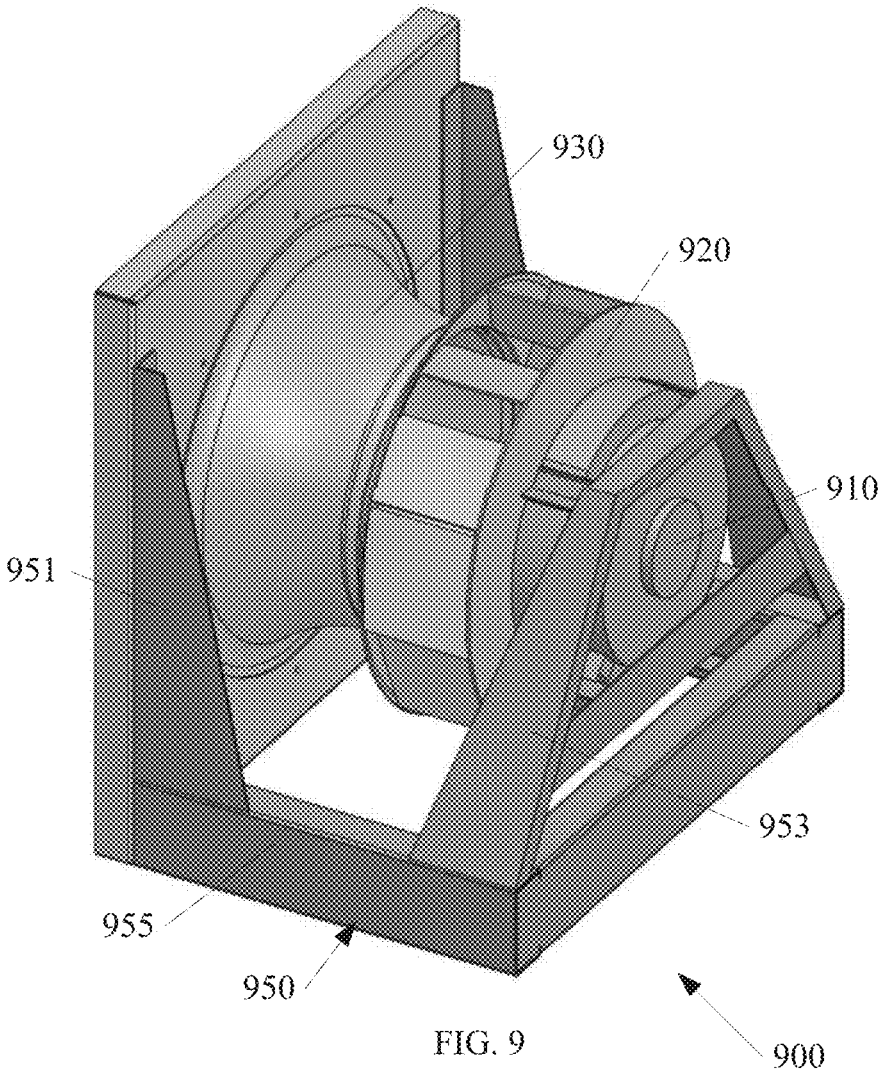
FIG. 9 is an isometric view of a fan assembly in accordance with some embodiments of the invention.

In the example of FIG. 9, a fan assembly 900 is shown, including a fan motor 910, and an impeller 920. As discussed above, a centrifugal impeller 920 is shown, however other impeller types may also be used with examples of the invention. An inlet funnel 930 is shown to direct air into an air inlet region of the impeller 920. FIG. 9 shows another support structure according to an example of the invention.

In the example of FIG. 9, the support members 950 include a back support 953 coupled to the motor and a front support 951 coupled to the inlet funnel 930 and a connecting support 955 between the back support 953 and the front support 951, the connecting support 955 being located on only one side of the fan assembly 900. In one example, such a structure of support members 950 completely removes support struts away from the impeller 920 and further reduces noise characteristics of the fan assembly 900. In one example, a particular noise characteristic improved by the configuration of FIG. 9 is tonal noise. Example configurations including support members 950 may be combined with one or more cooling configurations described in the present disclosure.

Figure 10:
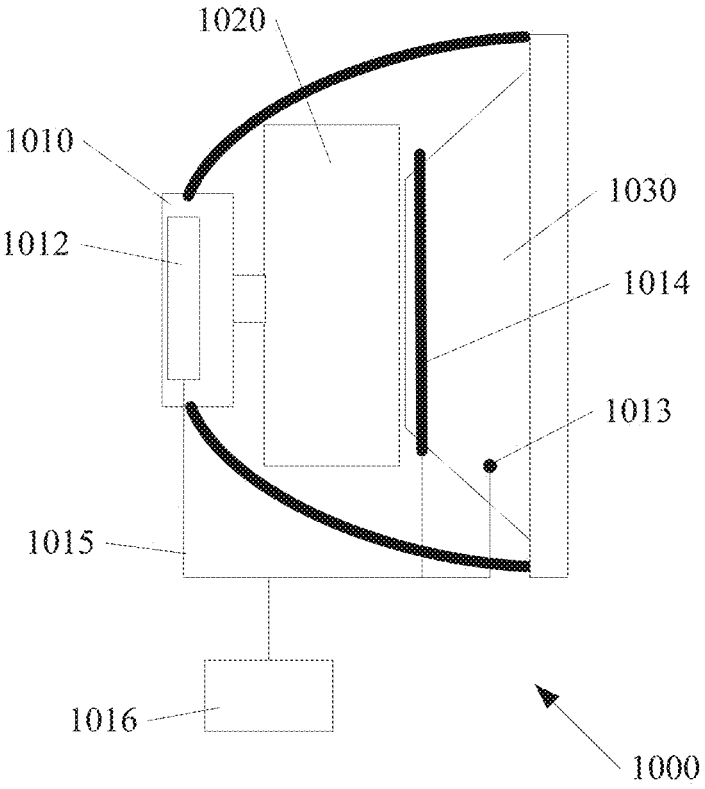
FIG. 10 is a block diagram of a fan assembly in accordance with some embodiments of the invention.

FIG. 10 shows another fan assembly 1000 according to an embodiment of the invention. The fan assembly includes a fan motor 1010, and an impeller 1020. An inlet funnel 1030 is further shown to direct air into an air inlet region of the impeller 1020.

FIG. 10 illustrates a fan motor 1010 that includes integrated control circuitry 1012. In one example, the fan motor 1010 is an electronically commutated motor. As discussed in examples above, electronically commutated motors having integrated control circuitry 1012 may benefit from additional motor cooling configurations, such as one or more examples described above.

In the example fan assembly 1000 of FIG. 10, the integrated control circuitry 1012 is configured to vary a speed of the electrically commutated motor in response to data from one or more performance data sensors. One example of a performance data sensor is shown in FIG. 10 as a differential pressure sensor. An inlet tap 1013 provides a first pressure, and a second tap 1014 provides a second pressure. In one example, the difference in pressure between the inlet tap 1013 and the second tap 1014 is used as data to adjust operation within the integrated control circuitry 1012. In one example, as shown in FIG. 10, the second tap 1014 includes a piezometer ring. Piezometer rings can be beneficial in sensing pressure drops in difficult regions such as a neck region of the inlet funnel 1030. In one example the piezometer ring 1014 averages readings around a periphery of the piezometer ring 1014 to use as a more accurate representation of pressure in the neck of the inlet funnel.

FIG. 10 also illustrates additional performance data sensors 1016. As illustrated by communication lines 1015, the performance data sensors 1016, optionally including the inlet tap 1013 and second tap 1014, provide data for use in the integrated control circuitry 1012. Examples of additional performance data sensors include, but are not limited to, a vibration sensor, support member strain sensor, bearing temperature sensor, lubrication level sensor, air discharge pressure sensor, air temperature sensor, motor speed sensor, motor torque sensor, motor voltage sensor, and motor current sensor.

In one example, the integrated control circuitry 1012 may use the data provided by the performance data sensors to adjust a speed of the fan motor 1010. Adjusting a speed of the fan motor 1010 may include varying the speed, or starting and stopping operation altogether if necessary. In one example, the integrated control circuitry 1012 may use the data provided by the performance data sensors to provide information to a user in response to data from the one or more performance data sensors. In one example, the control circuitry 1012 may provide an alarm to a user, such as high temperature, low lubrication level, etc. In one example, the control circuitry 1012 may provide data such as efficiency data or energy consumption data.

In one example the control circuitry 1012 includes wireless transmission and or receiving circuitry. In one example the control circuitry 1012 may communicate with the internet, and transmit data and/or warnings to a user to a computer, tablet computer, smart phone, or similar device.

Figure 11:
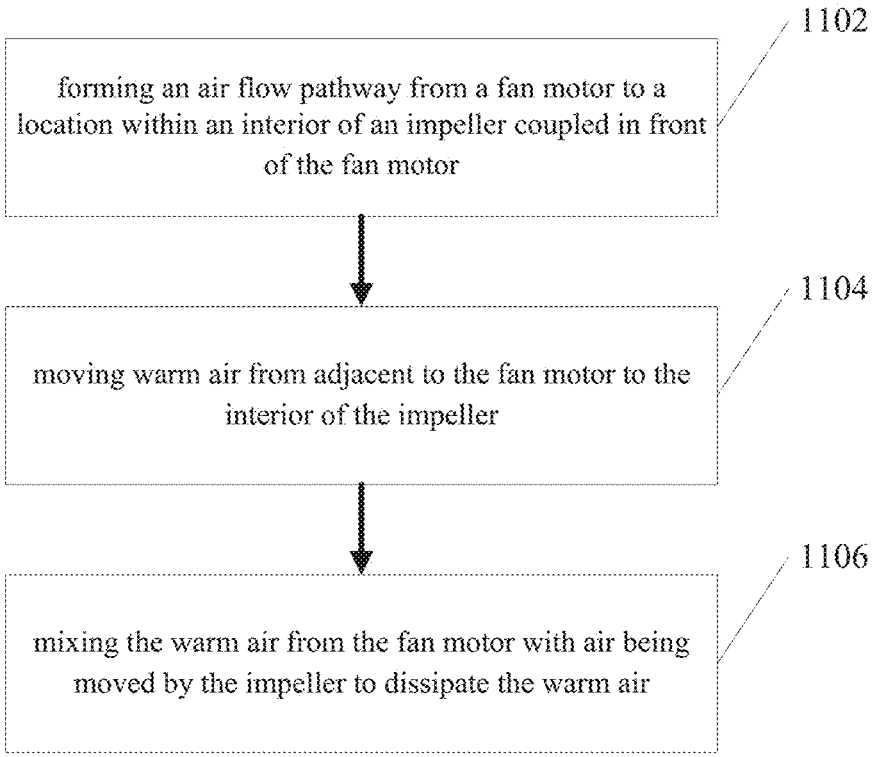
FIG. 11 is a flow diagram of a method of forming a fan housing in accordance with some embodiments of the invention.

FIG. 11 shows one example method of cooling a fan motor according to an embodiment of the invention. In operation 1102, an air flow pathway is formed from a fan motor to a location within an interior of an impeller coupled in front of the fan motor. In operation 1104 warm air is moved from adjacent to the fan motor to the interior of the impeller. In operation 1106, the warm air from the fan motor is mixed with air being moved by the impeller to dissipate the warm air.

To better illustrate the method and apparatuses disclosed herein, a non-limiting list of examples is provided here:

Example 1 includes a fan assembly. The fan assembly includes a fan motor, an impeller coupled to the fan motor, having an air inlet region and a periphery, an inlet funnel directing air to the air inlet region, and at least one deflector located at the periphery of the impeller to direct a portion of outflowing air over the fan motor.

Example 2 includes the fan assembly of example 1, further including the one or more diffusers located at the periphery of the impeller.

Example 3 includes the fan assembly of any one of examples 1-2, wherein the at least one deflector is substantially continuous around 360 degrees of the periphery.

Example 4 includes the fan assembly of any one of examples 1-3, wherein the at least one deflector includes multiple deflectors spaced around the periphery.

Example 5 includes the fan assembly of any one of examples 1-4, wherein the fan motor is an electronically commutated motor.

Example 6 includes the fan assembly of any one of examples 1-5, further including one or more performance data sensors, and wherein the electronically commutated motor includes integrated control circuitry configured to vary a speed of the electrically commutated motor in response to data from the one or more performance data sensors.

Example 7 includes the fan assembly of any one of examples 1-6, further including a hollow drive shaft in the fan motor to further direct air heated by the motor through the hollow drive shaft and into the air inlet region of the impeller.

Example 8 includes a fan assembly. The fan assembly includes a fan motor, including a hollow drive shaft, an impeller coupled to the motor, the impeller having a backplate, and a plurality of primary blades on a front side of the backplate that form a primary air inlet region and a periphery, and an inlet funnel directing air to the air inlet region.

Example 9 includes the fan assembly of example 8, further including a number of secondary blades on the front side of the backplate positioned to create a pressure differential and draw air through the hollow drive shaft.

Example 10 includes the fan assembly of any one of examples 8-9, wherein the pressure differential ranges from a high pressure at a backside of the fan motor to a low pressure within the air inlet region.

Example 11 includes the fan assembly of any one of examples 8-10, further including a number of cooling fins located on a face of the fan motor directly facing the backplate of the impeller.

Example 12 includes the fan assembly of any one of examples 8-11, further including a number of tertiary blades on a backside of the backplate to draw air over the motor.

Example 13 includes the fan assembly of any one of examples 8-12, wherein the fan motor is an electronically commutated motor.

Example 14 includes the fan assembly of any one of examples 8-13, further including one or more performance data sensors, and wherein the electronically commutated motor includes integrated control circuitry configured to vary a speed of the electrically commutated motor in response to data from the one or more performance data sensors.

Example 15 includes a fan assembly. The fan assembly includes a fan motor, an impeller coupled to the motor, the impeller having a backplate, and a plurality of primary blades on a front side of the backplate that form a primary air inlet region and a periphery, an inlet funnel directing air to the air inlet region, and a number of secondary blades on a backside of the backplate to draw air over the motor.

Example 16 includes the fan assembly of example 15, wherein the fan motor is an electronically commutated motor.

Example 17 includes the fan assembly of any one of examples 15-16, further including one or more performance data sensors, and wherein the electronically commutated motor includes integrated control circuitry configured to vary a speed of the electrically commutated motor in response to data from the one or more performance data sensors.

Example 18 includes a fan assembly. The fan assembly includes a fan motor, an impeller coupled to the motor, the impeller having a backplate, and a plurality of primary blades on a front side of the backplate that form a primary air inlet region and a periphery, an inlet funnel directing air to the air inlet region, and a number of holes in the backplate of the impeller to draw air over the motor.

Example 19 includes the fan assembly of example 18, further including a number of secondary blades on a backside of the backplate to draw air over the motor.

Example 20 includes the fan assembly of any one of examples 18-19, wherein the fan motor is an electronically commutated motor.

Example 21 includes the fan assembly of any one of examples 18-19, further including one or more performance data sensors, and wherein the electronically commutated motor includes integrated control circuitry configured to vary a speed of the electrically commutated motor in response to data from the one or more performance data sensors.

Example 22 includes a fan assembly. The fan assembly includes a fan motor, an impeller coupled to the motor, the impeller having a backplate, and a plurality of primary blades on a front side of the backplate that form a primary air inlet region and a periphery, a number of cooling fins located on a face of the fan motor directly facing the backplate of the impeller, and an inlet funnel directing air to the air inlet region.

Example 23 includes the fan assembly of example 22, further including a number of secondary blades on a backside of the backplate to draw air over the motor.

Example 24 includes the fan assembly of any one of examples 22-23, further including a number of holes in the backplate of the impeller to draw air over the motor.

Example 25 includes the fan assembly of any one of examples 22-24, wherein the fan motor is an electronically commutated motor.

Example 26 includes the fan assembly of any one of examples 22-25, further including one or more performance data sensors, and wherein the electronically commutated motor includes integrated control circuitry configured to vary a speed of the electrically commutated motor in response to data from the one or more performance data sensors.

Example 27 includes a fan assembly. The fan assembly includes a fan motor, an impeller coupled to the motor, the impeller having an air inlet region and a periphery, an inlet funnel directing air to the air inlet region, an outlet channel located at the periphery of the impeller, and one or more channels to draw air from the motor to a front of the inlet funnel.

Example 28 includes the fan assembly of example 27, wherein the fan motor is an electronically commutated motor.

Example 29 includes the fan assembly of any one of examples 27-28, wherein the channels are integral with motor support members.

Example 30 includes the fan assembly of any one of examples 27-29, wherein the support members are in four corners of the inlet funnel.

Example 31 includes the fan assembly of any one of examples 27-30, wherein the support members include a back support coupled to the motor and a front support coupled to the inlet funnel and a connecting support between the back support and the front support, the connecting support being located on only one side of the fan assembly.

Example 32 includes a fan assembly. The fan assembly includes an electrically commutated motor, an impeller coupled to the electrically commutated motor, the impeller having an air inlet region and a periphery, an inlet funnel directing air to the air inlet region, one or more performance data sensors, and control circuitry integrated with the electrically commutated motor configured to vary a speed of the electrically commutated motor in response to data from the one or more performance data sensors.

Example 33 includes the fan assembly of example 32, wherein the one or more performance data sensors includes a sensor to detect a pressure differential between a location on the inlet funnel distal to the impeller, and a location on the inlet funnel proximal to the impeller.

Example 34 includes the fan assembly of any one of examples 32-33, wherein the sensor includes at least one piezometer ring.

Example 35 includes the fan assembly of any one of examples 32-34, wherein the one or more performance data sensors includes sensors chosen from a group consisting of vibration sensor, support member strain sensor, bearing temperature sensor, lubrication level sensor, air discharge pressure sensor, air temperature sensor, motor speed sensor, motor torque sensor, motor voltage sensor, and motor current sensor.

Example 36 includes the fan assembly of any one of examples 32-25, further including control circuitry integrated with the electrically commutated motor configured to provide information to a user in response to data from the one or more performance data sensors.

Example 37 includes the fan assembly of any one of examples 32-36, wherein the control circuitry is configured to provide one or more alarms to a user.

Example 38 includes the fan assembly of any one of examples 32-37, wherein the control circuitry is configured to provide fan performance information to a user.

Example 39 includes the fan assembly of any one of examples 32-38, further including wireless transmission circuitry to transmit the information to the user.

Example 40 includes a method of cooling a fan motor. The method includes forming an air flow pathway from a fan motor to a location within an interior of an impeller coupled in front of the fan motor, moving warm air from adjacent to the fan motor to the interior of the impeller, and mixing the warm air from the fan motor with air being moved by the impeller to dissipate the warm air.

Example 41 includes the method of example 40, wherein forming an air flow pathway includes forming a hollow drive shaft within the fan motor.

Example 42 includes the method of any one of examples 40-41, wherein forming an air flow pathway includes forming one or more holes in a backplate of the impeller.

Example 43 includes the method of any one of examples 40-42, wherein forming an air flow pathway includes forming one or more enclosed channels that lead from a back side of the fan motor to a front side of an inlet funnel located in front of the impeller.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A fan assembly, comprising:

a fan motor, including a hollow drive shaft;

an impeller coupled to the fan motor, the impeller having a backplate, and a plurality of primary blades on a front side of the backplate that form a primary air inlet region and a periphery;

an inlet funnel directing air to the primary air inlet region;

a number of secondary blades on a back side of the backplate;

at least one support member that hold the fan motor in relation to the inlet funnel, wherein the at least one motor support member is configured to channel the air through the at least one motor support member between the fan motor and a front of the inlet funnel; and a number of tertiary blades on the front side of the backplate positioned to create a pressure differential and draw the air through the hollow drive shaft.

2. The fan assembly of claim 1, wherein the pressure differential ranges from a high pressure at a backside of the fan motor to a low pressure within the primary air inlet region.

3. The fan assembly of claim 1, wherein the number of secondary blades on the backside of the backplate are positioned on a periphery of the backplate.

4. The fan assembly of claim 1, wherein the fan motor is an electronically commutated motor.

5. The fan assembly of claim 4, further including one or more performance data sensors, and wherein the electronically commutated motor includes integrated control circuitry configured to vary a speed of the electrically commutated motor in response to data from the one or more performance data sensors.

* * * * *